United States Patent [19]

Kennamer

[11] Patent Number: 4,740,043

[45] Date of Patent: Apr. 26, 1988

[54] TRAY ARRESTING DEVICE

[76] Inventor: Jack J. Kennamer, 39 W. McMillan Apt. #12, Cincinnati, Ohio 45219

[21] Appl. No.: 10,954

[22] Filed: Feb. 4, 1987

[51] Int. Cl.[4] ..... A47B 81/00

[52] U.S. Cl. ..... 312/211; 248/214; 248/294; 248/304; 248/339; 312/271

[58] Field of Search ..... 248/214, 218.1, 208, 248/231.7, 227, 294, 301, 304, 339, DIG. 7; 312/211, 271

[56] References Cited

U.S. PATENT DOCUMENTS

| | | | |
|---|---|---|---|
| 454,887 | 6/1891 | Stainton . | |
| 2,474,943 | 7/1949 | Hedeer | 248/214 X |
| 3,584,752 | 6/1971 | Ettlinger et al. | 414/425 |
| 4,062,604 | 12/1977 | Popper | 312/211 |
| 4,101,107 | 7/1978 | Antoszewski | 248/294 X |
| 4,303,285 | 12/1981 | Wiegers | 312/211 |
| 4,494,657 | 1/1985 | Oldenkamp | 209/636 |
| 4,519,507 | 5/1985 | Gillette et al. | 209/630 X |
| 4,584,813 | 4/1986 | Hudson | 248/214 X |

FOREIGN PATENT DOCUMENTS

| | | | |
|---|---|---|---|
| 0150685 | 3/1953 | Australia | 312/271 |

*Primary Examiner*—Ramon O. Ramirez

*Attorney, Agent, or Firm*—Wood, Herron & Evans

[57] ABSTRACT

A device for preventing a food tray from falling into a waste can is mounted to a can housing and presents one or more hook arms which arrest the tray as it is being inserted into the housing for emptying into the can. The tray is retained in a position such that it is visible from and can be retrieved from outside the housing.

11 Claims, 1 Drawing Sheet

TRAY ARRESTING DEVICE

FIELD OF THE INVENTION

This invention relates to a device for preventing a food tray from falling into a waste can, and is intended for use in commercial food services.

BACKGROUND

At fast food and other restaurants the customer often receives his or her food on a tray. After eating, the customer is supposed to dispose of the paper and food waste by pushing the tray through a tray opening into a trash receptacle housing, and then dumping the waste off the tray into a can within the housing. The tray is then stacked for reuse, typically along side of or on top of the housing. Sometimes, however, the customer drops the tray into the can along with the waste. Similar tray loss can also occur in industrial and institutional food services where food is carried on trays.

Because it is slow and disagreeable to sort through waste in a can to recover any trays, trays are frequently lost in this manner. The expense of such loss becomes substantial over a period of time.

Typically the waste can is concealed in a housing, usually in the form of a four-sided enclosure, from which the can can be removed for emptying. The housing usually presents a tray opening with a swinging door or panel above the top of the can, through which the tray can be inserted so that the trash can be slid off it. The tray opening is wide enough to present access to virtually the entire width of the can within the housing, and is typically wider than the tray itself so that the tray can be inserted through it for emptying. If the tray is not retained, it can drop out of sight into the can inside the housing, where it will soon be covered and lost.

Thus there has been a need for a device which can be installed or retrofitted onto the can housing, and which will permit waste to be slid from the tray into the can without impeding it, yet which will retain the tray in a position such that it cannot easily be dropped into the can, and which will hold the tray in a position such that it can be recovered from outside the housing, through the tray opening.

THE PRIOR ART

Stainton U.S. Pat. No. 454,887 shows a combined cinder-sifter and garbage receptacle. Ettlinger et al U.S. Pat. No. 3,584,752 shows a device for discharge of tableware from a tray into a dishwasher while the tray is being moved by conveyor. The tray is conveyed laterally past a discharge station and is tilted inwardly by a belt which engages and lifts one edge of the tray while the opposite edge of the tray slides along and is restrained by an edge guide.

Oldenkamp U.S. Pat. No. 4,494,657 shows a device for magnetically separating flatware from food in a garbage compartment.

Gillette U.S. Pat. No. 4,519,507 is directed to means for sorting tags or tacks of a type attached to garments to prevent theft.

BRIEF DESCRIPTION OF THE INVENTION

A conventional waste bin or can having a top opening is enclosed in a housing which has a tray opening (usually at the front, or in a front wall) in the form of a slot or door through which waste can be discharged from a tray into the top of the can. Tray arresting means are provided which comprise at least one arm mounted interiorly of the housing, adjacent the tray opening and extending inwardly from above the can. The arm is elongated and angles downwardly into the open top of the can. The arm is positioned to guide or support a tray, inserted through the tray opening, toward and over the can. An upstanding hook is provided at the inner end of the arm, which is positioned to arrest the movement of the tray downwardly along the arm, at a position such that the tray does not fall into the can and can be recovered through the tray opening from outside the housing.

The arm preferably projects downwardly into the housing from the front thereof, with the hook below the top of the can and actually inside the can. The arm is preferably swingable about a horizontal axis so that it will lift to permit the can to be slid out from beneath it. A pair of two such arms, which may be integral, is preferably provided.

DESCRIPTION OF THE DRAWINGS

The invention can best be further described by reference to the accompanying drawings, in which.

DETAILED DESCRIPTION

Figure 1:
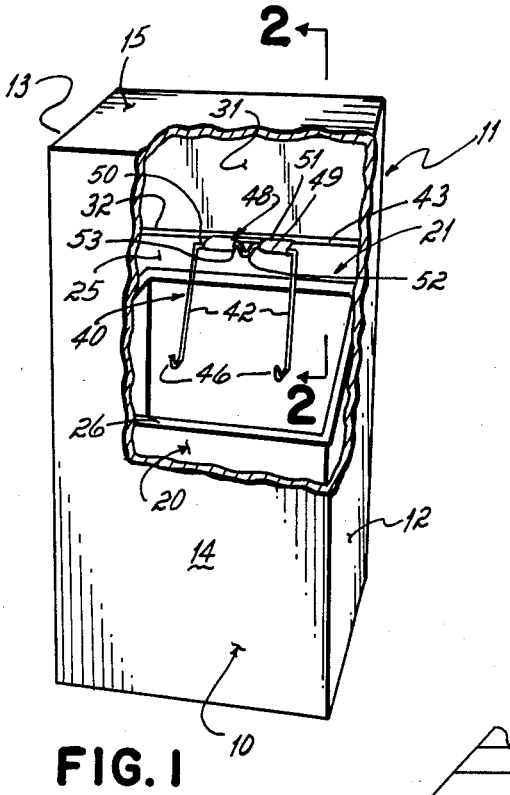
FIG. 1 is a rear perspective view, partly broken away, of a housing containing a trash can and shows a preferred form of tray arresting service mounted inside the housing.
Figure 3:
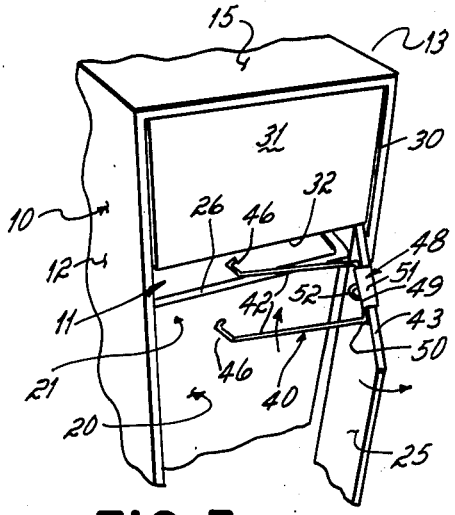
FIG. 3 is a fragmentary front perspective view and shows the manner in which the device lifts when the can removal door is opened, so that the can can be removed from the housing for emptying.

In the drawings, a trash can housing is designated generally at 10. This housing is typically a rectangular enclosure, made of laminate, and has a front 11, sides 12 and 13, a back 14, and a top 15. Housing 10 is dimensioned to receive a trash can or bin 20, which is usually rectangular for full space utilization. The trash can 20 fits within an interior compartment 21 within housing 10. Usually, the front 11 or, less frequently, the back 14 of housing 10 has an opening through which the can 20 can be removed for emptying. In the embodiment disclosed, housing front 11 includes a can removal door 25 which is hinged to side 13 to swing about a vertical axis. Typically door 25 extends just above the top edge 26 of can 20, see FIG. 2.

Access for dumping food and other waste into can 20 is provided in the front of the housing through a tray opening 30, which is closed by a tray door 31. This door 31 is hinged at its top edge to the housing top 15, so that it can swing inwardly, above can 20, to accommodate a tray to be emptied. The lower edge 32 of door 31 closes just above the top of can removal door 25 (see the dotted line position in FIG. 2).

Figure 2:
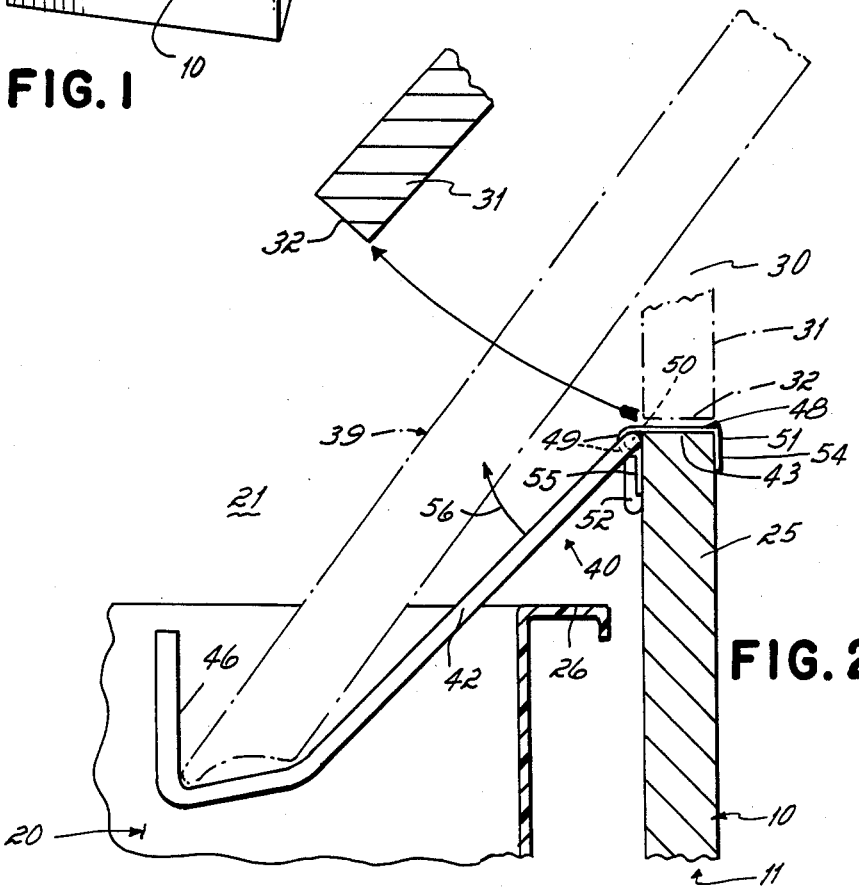
FIG. 2 is an enlarged vertical cross section, partly diagrammatic in nature, taken on line 2—2 of FIG. 1 and shows the manner in which the device arrests a tray inserted through a tray door.

A food tray, which may be conventional such as that designated by 39 in FIG. 2, can be inserted into opening 30, through tray door 31, and the food scraps and other waste dumped or pushed off the tray, into can 20. The size of the opening 30 is typically such that the entire tray can pass through it; if not retained, the tray can drop into can 20 below, along with the waste.

Housing 10 and can 20 as thus far described may be conventional and do not themselves comprise the invention. The tray arresting device of the invention can be retrofitted to existing trash can housings, or provided on new installations, as will now be explained.

A preferred form of tray arresting device in accordance with the invention is designated generally at 40 in the drawings and comprises at least one arm 42, and in the embodiment shown, preferably two parallel such arms integrally formed of heavy gauge wire and connected by an integral axle portion 50 which extends transversely (perpendicularly) between them. The device 40 is mounted to the housing front, preferably to the can removal door 25 just inwardly of its top edge 43 (see FIG. 2), below tray door 31. Each arm 42 projects downwardly from its mount, part way across and into the open top of can 20. Adjacent its lower end each arm 42 has an upstanding hook or tip 46. The arm 42 is positioned and angulated to guide or support a tray 39 and prevent it from dropping into can 20. Hook 46 at the inner end of the arm is configured to arrest the tray and prevent it from sliding or dropping into the can from opening 30 and to hold the tray as shown in FIG. 2 so that it can be retrieved from tray opening 30.

The device is hinged at its upper end to the housing as by a strap hinge 48. Suitably the hinge is mounted to the can removal door 25, as shown in FIG. 2. For this purpose strap hinge 48 has an arcuate portion 49 positioned on the inside of door 25 which receives and journals axle portion 50, and a C-shaped mounting clamp or attaching portion 51 which hooks over and grips the top of door 25. Clamp portion 51 has spaced downwardly extending flanges 54, 55 which facially engage the outside and inside faces respectively of door 25 to grip it between them. Screws or adhesive may be provided to secure the hinge, but ordinarily spring tension between flanges 54 and 55 of clamp portion 51 is sufficient, and enables the device to be quickly attached and removed if desired.

Preferably the device includes two such arms 42, which are provided as an integral pair or bail in the shape of an inverted U, with the axle portion 50 between the two arms 42, 42 extending horizontally. The central area of axle portion 50 has a V-shaped offset stop portion 52 which normally rests against the inner surface of door 25, or against flange 55 (see FIG. 2) so as to limit the hinged movement of the arms about their axis of rotation. Strap hinge 48 is provided with a central opening 53 which permits the V-shaped stop 52 to engage the door, and the arms be swung upwardly over can 20 as shown by dotted line 56 in FIG. 2. The two arms 42 project laterally at positions which are roughly $\frac{1}{3}$ and $\frac{2}{3}$ of the width of tray opening 30.

As shown in FIG. 2, typically the top of the can has a rolled or downturned top edge 26. It is desirable that each arm 42 extend into the can top. The arms 42 do not contact can top edge 26 because the hinge stop portion 52 bears against the inside face of door 25. The door itself thus supports the arms and holds them in an effective tray arresting position, as shown.

Even if the tray is inserted diagonally through opening 30, the device will arrest and hold it. A tray cannot normally pass even a single arm; the arm will hold it so that it rests against the side of opening 30. If a corner of the tray passes between the two hooks, the hooks arrest the adjacent sides of the tray and hold it caught between them again, so that the tray is partly visible outside the housing and can easily be recovered.

When it is desired to remove can 20 from housing 10 by opening can removal door 25, the hinging or swingability of the arms permits them to swing upward about hinge portion 50 as the door is opened, so that they pass across and clear the top of the can. The can can then be removed.

Having described the invention, what is claimed is:

1. A device for preventing a food tray from falling into a waste can, comprising:

a waste can having an open top, a housing in which said can is removably housed, the housing having walls presenting a tray opening through which waste can be discharged from a tray into the can inside the housing, and at least one elongated downwardly extending arm mounted by said housing adjacent said tray opening and slanting downwardly at an angle into the open top of said can, said arm having an upstanding hook adjacent an inner end thereof, said arm and hook positioned to arrest the movement of a tray from said tray opening into said can and to hold the tray out of the can in such position that it can be retrieved through the tray opening from outside the housing.

2. The device of claim 1 further wherein said housing has a can removal door through which said can can be removed, and said arm is mounted to said can removal door at a position thereon above the can.

3. The device of claim 1 wherein said arm is hinged about a horizontal axis so that it can be swung upwardly to permit said can to be removed from beneath it.

4. The device of claim 1 wherein a pair of such arms is provided, projecting over the can at laterally spaced positions below said tray opening.

5. The device of claim 4 wherein said pair of arms are formed integrally and have a laterally extending hinge portion between them which is hinged to the inside of said housing, below said opening.

6. The device of claim 5 wherein said hinge portion has an offset stop portion which engages the housing and thereby limits the hinged movement of the arms.

7. The device of claim 1 wherein said housing has a can removal door and said arm is mounted to said door.

8. The device of claim 7 wherein said arm includes a clamp mounting portion which grips said door along an edge of the door.

9. The device of claim 8 wherein said device includes two such arms, said device being generally U-shaped with said arms forming the sides of the U and being connected by a hinge portion, and further wherein said housing includes a can removal door and said hinge portion is hinged to said door.

10. The device of claim 9 wherein said hinge portion is mounted to said door adjacent a top edge of the door, by mounting means comprising a clamp which grips said top edge.

11. A device for mounting to the top edge of a wall of a trash can enclosure for preventing a food tray from falling into a trash can within the enclosure, said device comprising, a bail having a pair of spaced parallel arms each having an upstanding hook adjacent an outer end thereof, the arms and hooks sized to support a tray between them, said bail having an axle portion connecting the arms, the arms projecting perpendicularly from the axle portion, and a hinge comprising an attaching portion having two parallel flanges for engaging opposite faces of a wall of said enclosure at said top edge thereof, said flanges spaced by an amount equal to the thickness of said wall, and an arcuate portion between said flanges for receiving and journaling said axle portion, said axle portion including an offset stop portion for limiting swinging movement of said bail about said hinge and holding said arms in a rest position such that in use said arms slant angularly downwardly and outwardly from said parallel flanges.

* * * * *